United States Patent [19]

Yake

[11] 3,966,246

[45] June 29, 1976

[54] DOOR LATCH FOR APPLIANCES AND THE LIKE

[75] Inventor: William H. Yake, Connersville, Ind.

[73] Assignee: Design and Manufacturing Corporation, Connorsville, Ind.

[22] Filed: Jan. 21, 1975

[21] Appl. No.: 542,653

[52] U.S. Cl. ..... 292/241

[51] Int. Cl.[2] ..... E05C 3/22

[58] Field of Search..... 292/DIG. 49, 201, DIG. 69, 292/200, 228, 111, 192

[56] References Cited

UNITED STATES PATENTS

| | | | |
|---|---|---|---|
| 3,011,816 | 12/1961 | Van Noord | 292/DIG. 69 |
| 3,099,471 | 7/1963 | Scott et al. | 292/DIG. 69 |

FOREIGN PATENTS OR APPLICATIONS

| | | | |
|---|---|---|---|
| 662,756 | 4/1964 | Italy | 292/DIG. 49 |

*Primary Examiner*—Richard E. Moore
*Attorney, Agent, or Firm*—Melville, Strasser, Foster & Hoffman

[57] ABSTRACT

In an appliance of the type having a cabinet with a chamber therein and an access door for the chamber, an improved latch mechanism for opening, closing and latching the appliance door. The latch mechanism comprises a strike mounted on one of the appliance cabinet and the appliance door and a support plate affixed to the other of the appliance cabinet and the appliance door. A latch lever is mounted on the support plate and is rotatable between open and closed positions. The latch lever carries a link non-rotatively affixed thereto and a bolt pivotally affixed to the link. The bolt is swingable with respect to the link between a normal position and a latching position. Means are provided to bias the bolt to its normal position. The strike has surfaces thereon to shift the bolt from its normal position to its latching position upon the closing of the door and the rotation of the latch lever to its closed position. Means may be provided on the bolt to actuate a door safety switch when the bolt is in its latching position.

11 Claims, 11 Drawing Figures

DOOR LATCH FOR APPLIANCES AND THE LIKE

BACKGROUND OF THE INVENTION

1. Field of the Invention

The invention relates to a latch mechanism and more particularly to a latch mechanism for the door of an appliance or the like adapted to actuate a door safety switch for the appliance when the door is fully closed and latched.

2. Brief Description of the Prior Art

The latch mechanism of the present invention may have many applications. While not necessarily so limited, the latch mechanism is particularly adapted for use with appliances of the type having a cabinet with a chamber and a door for closing the chamber. The latch mechanism may also be used to actuate a door safety switch, i.e. an appliance enabling switch, so that the appliance may perform its functions only when its door is firmly closed and latched. Exemplary applications of the latch mechanism of the present invention include cooking ovens, microwave cooking ovens, clothes washing machines and the like. For purposes of an exemplary showing, the latch mechanism will be described in association with an under-counter dishwashing machine.

The typical under-counter dishwashing machine has a cabinet with a vat or tub located beneath a sink or countertop. A front opening door is provided for the vat, the bottom edge of the door being hinged to the dishwasher cabinet and the door being swingable between a vertical closed position and a horizontal open position. The latch mechanism of the present invention provides a means whereby the door may be opened and closed and latched securely in a closed position. When in its closed and latched position, the bolt of the latch mechanism may be used to actuate a door safety switch to initiate, or permit initiation of, the dishwashing cycle.

Prior art workers have devised numerous types of latch mechanisms for appliances, some of which have safety switches in association therewith. United States Letters Patent 3,323,822 illustrates an exemplary prior art latch of this type. In accordance with the teachings of this patent, inadvertent actuation of the safety switch, when the door is not fully closed and latched, is avoided by the provision of a special trip means preventing the latch itself from being shifted to its closed position until the door is moved into a predetermined spaced relationship with a tub mounted strike. When the door is properly closed and latched, a portion of the latch lever itself actuates the door safety switch.

The present invention is based upon the discovery that a portion of the bolt itself may be used to actuate the door safety switch when the bolt is in its closed and latching position. This enables further simplification of the latch mechanism, eliminating the necessity for trip means and the like. The latch mechanism is sturdy, less expensive to manufacture and easier to operate. Despite its simplicity, the latch mechanism of the present invention may be so designed as to provide a mechanical advantage to assist in pulling the appliance door to its fully closed position.

SUMMARY OF THE INVENTION

The latch mechanism comprises a strike and a support plate to which the remainder of its operating instrumentalities are affixed. While not necessarily so limited, in its usual application to an under-counter dishwasher, for example, the strike will be mounted on the dishwasher cabinet and the plate will be affixed to the inner wall of the door assembly. A latch lever is rotatively mounted on the support plate. The latch lever comprises a rod-like element, one end of which forms a laterally extending lever handle. The free end of the latch lever carries a bolt and link assembly. The link is non-rotatively affixed to the free end of the latch lever. The bolt, in turn, is pivotally affixed to the link.

The latch lever is swingable between open and closed positions. The bolt-link assembly swings with the latch lever. The bolt, on the other hand, is independently swingable with respect to the link between a normal position and a latching position. When the appliance door is open, the latch lever may be shifted between its open and closed positions, but the bolt will remain in its normal position. When the door approaches its closed position, and as the latch lever is shifted from its open position to its closed position, surfaces on the strike will cause the bolt to assume its latching position. In passing from its normal position to its latching position, the bolt executes an over-center action with respect to the pivot point between the bolt and latch. This assures that when the door is closed and the bolt is in its latching position, the door will be tightly shut and firmly latched. This further enables the latch mechanism to assist in pulling the door to its fully seated and closed position, as will be described hereinafter.

Finally, the bolt, itself, carries a lug which will engage the actuator of a door safety switch and cause the switch to assume a "closed" mode only when the bolt is in its latching position.

BRIEF DESCRIPTION OF THE DRAWINGS

FIG. 9 is a perspective view of the latch mechanism of the present invention in its closed and unlatched position.

DESCRIPTION OF THE PREFERRED EMBODIMENTS

Figures 1, 2, 3:
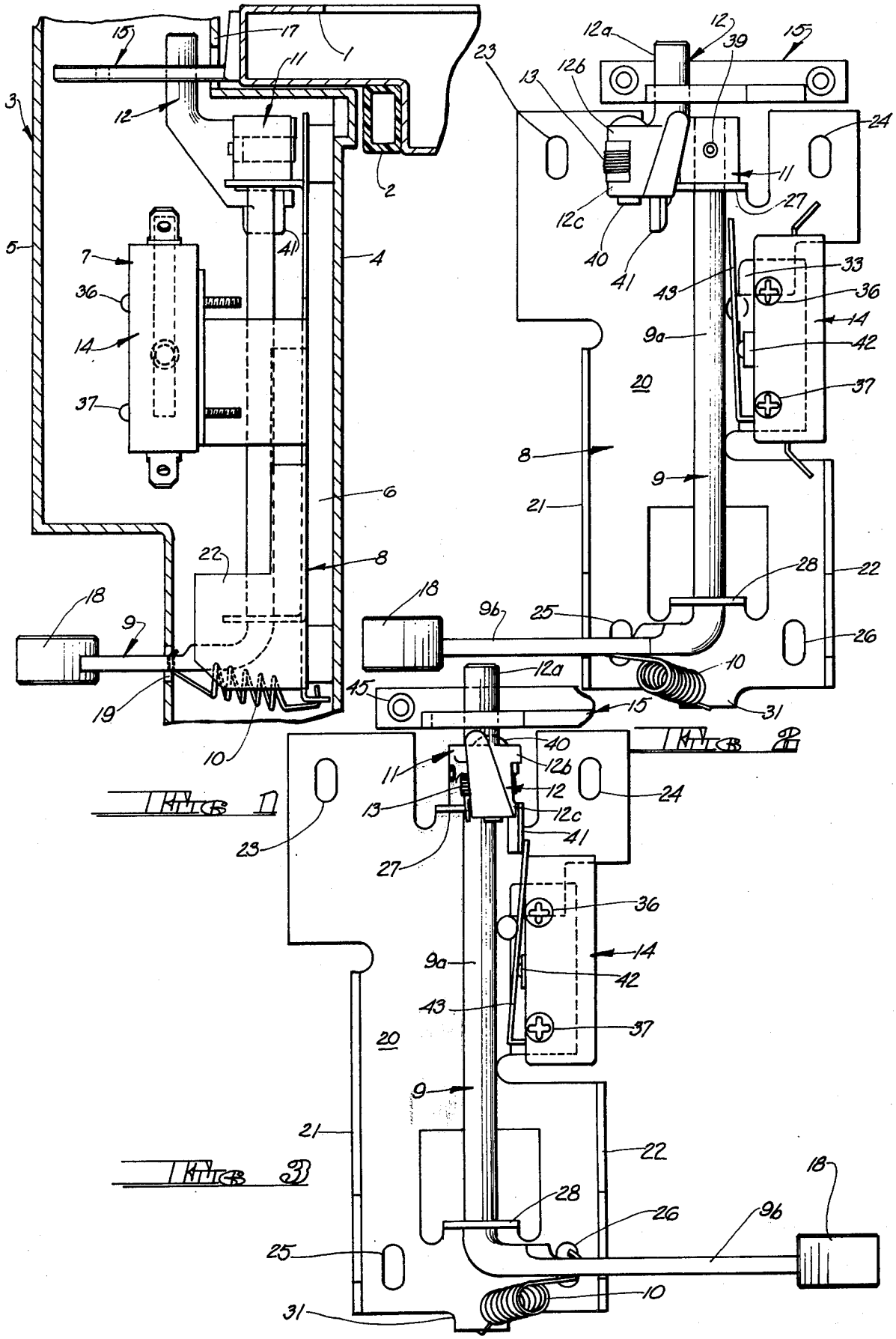
FIG. 1 is a fragmentary side elevational view, partly in cross section, illustrating a portion of the cabinet and door of an under-counter dishwasher and showing the application of the latch mechanism of the present invention thereto.
FIG. 2 is a front elevational view of the latch mechanism of the present invention in its open position.
FIG. 3 is a fragmentary front elevational view of the latch mechanism of the present invention in its closed and latching position.
Figure 3:
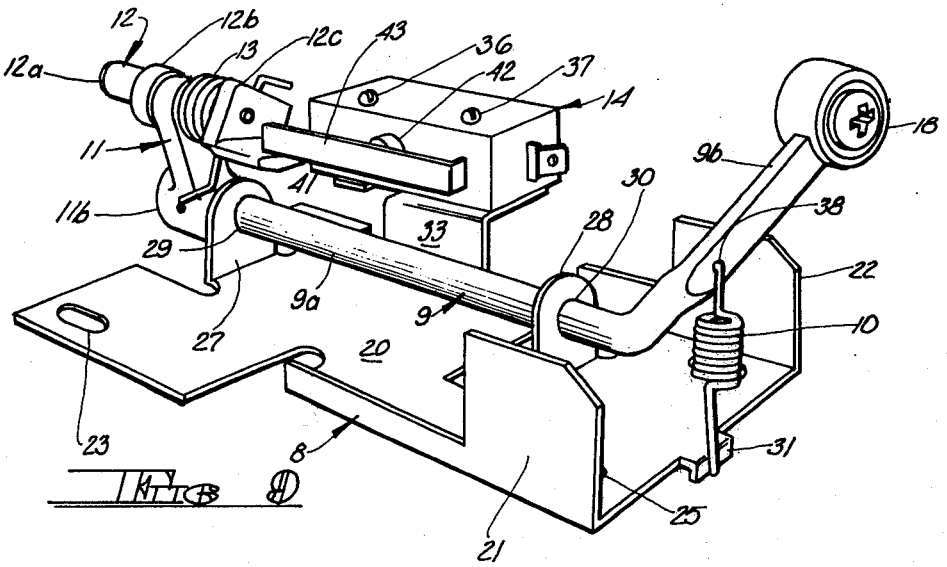

In FIG. 1 a portion of dishwasher cabinet, i.e. the top flange of the tub or vat, is indicated at 1. The tub is provided with a gasket means 2 with which the door is in sealing engagement when fully closed. The top portion of the dishwasher door is indicated generally at 3 and comprises an inner wall 4 and an outer wall 5. Appropriate bracket means 6 is affixed to the inner wall 4 in any suitable manner. The bracket 6 supports the latch assembly of the present invention, generally indicated at 7. The latch assembly 7 is affixed to bracket 6 by machine screws or other appropriate fastening means (not shown).

The primary elements of the latch assembly of the present invention comprise a housing or support plate 8, a latch lever 9, a latch spring 10, a link 11, a bolt 12, a link and bolt assembly spring 13 (see FIGS. 2, 3 and 6 through 9), a door safety switch 14 and a strike 15. All of the parts listed above are supported on the latch housing or support plate 8, save the strike 15 which is affixed by screws or other appropriate fastening means (not shown) to the top flange 1 of dishwasher tub or vat, as shown in FIG. 1. As is further shown in FIG. 1, the strike 15 is adapted to extend through a perforation 17 in the inner wall 4 of the dishwasher door when the door approaches its closed position. To be accessible to the dishwasher operator, a portion of the latch lever 9, carrying lever handle 18 extends through a perforation 19 in the outer wall 5 of the door.

Figure 4:
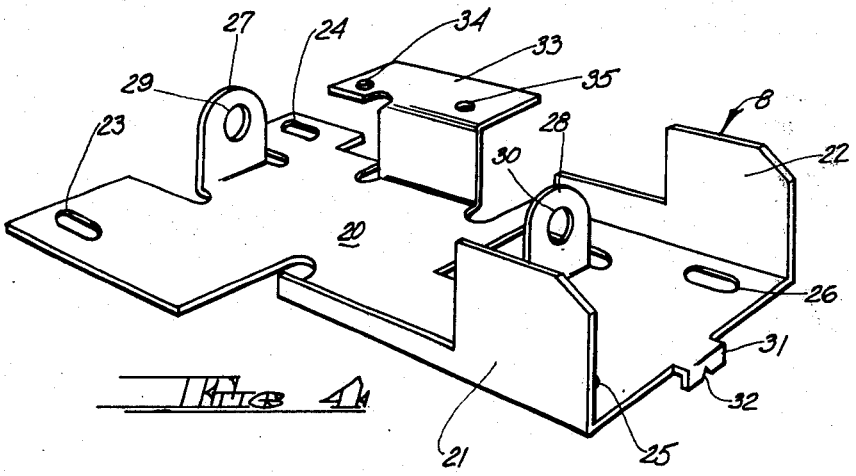
FIG. 4 is a perspective view of the latch housing or support plate.

For a more detailed description of the latch mechanism, reference is first made to FIG. 4 wherein the housing or support plate 8 is shown in perspective. The support plate has a planar primary portion 20 with upturned strengthening sides 21 and 22. A series of perforations 23 through 26 are formed in the primary portion 20 for the mounting screws or fastening means (not shown), which affix the support plate to the bracket 6 (FIG. 1). The perforations 23 through 26 may be elongated as shown to permit proper position adjustment of the support plate during the mounting of the support plate to the bracket 6.

A pair of upstanding tabs 27 and 28 are formed from the primary portion 20 and are provided with perforations 29 and 30, respectively. As will be described hereinafter, these tabs are adapted to rotatively mount the latch lever 9. An integral outwardly and downwardly extending flange 31 is provided, having a notch 32 the purpose of which will be described hereinafter.

Finally, the support plate has an upwardly and outwardly extending bracket 33 formed from the primary portion 20. Bracket 33 has a pair of perforations 34 and 35. This bracket is intended to support the safety microswitch 14 which is affixed thereto by appropriate fastening means such as machine screws 36 and 37 (see FIG. 1).

Figure 7:
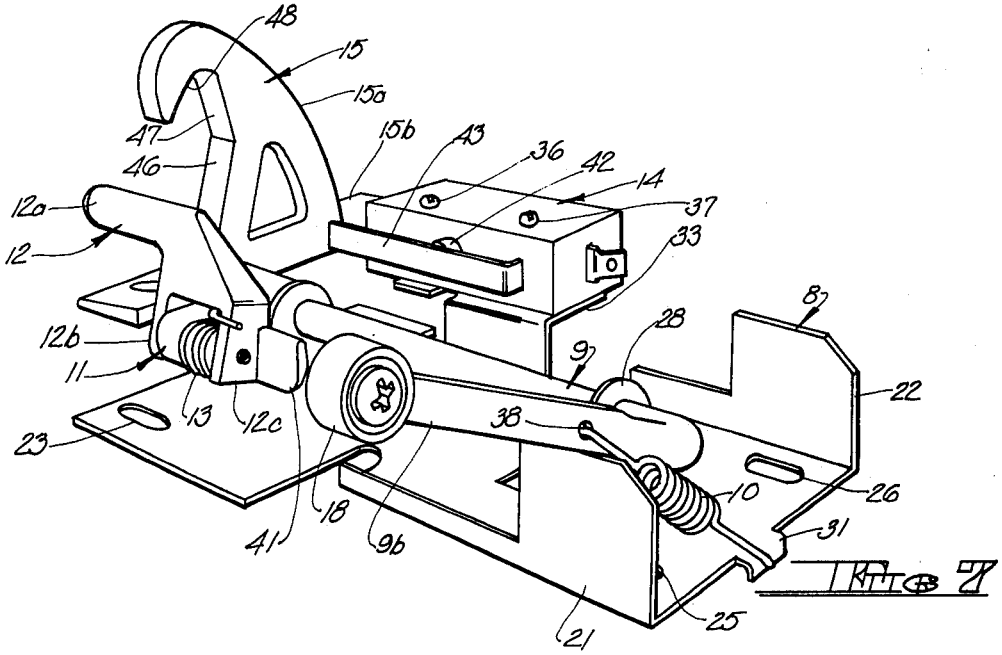
FIG. 7 is a perspective view of the latch mechanism of the present invention in its open position.

Turning to FIGS. 2 and 7, the latch lever 9 comprises an L-shaped member having a rod-like portion 9a which extends through perforations 29 and 30 in tabs 27 and 28 and is rotatable therein. At its lowermost end, latch lever 9 terminates in a laterally extending portion 9b carrying the latch handle 18. The portion 9b may be of flattened configuration as shown, so that the perforation or slot 19 in the door outer wall 5 through which it extends may be relatively narrow. Latch spring 10 has a first hook-shaped end 10a adapted to engage notch 32 in tab 31 of the support plate. Spring 10 has a second hook-like end 10b adapted to engage a perforation 38 in the portion 9b of latch lever 9. It will be evident from a comparison of FIGS. 2 and 7 on the one hand and FIGS. 3 and 8 on the other that as the latch lever 9 swings between its open and closed or latched positions, spring 10 will bias the latch to either of these positions with an over-center action. Upturned flanges 21 and 22 on support plate 20 serve as stops for latch lever 9, determining its open and closed or latched positions, respectively.

The link and bolt assembly of the present invention is non-rotatively mounted on the free end of portion **9*a* of latch lever 9. The bolt and link assembly is most clearly shown in FIG. 6. Link 11 comprises an elongated body 11a terminating at one end in a cylindrical portion 11b having a perforation therethrough adapted to receive the free end of portion 9*a* of latch lever 9. The link is non-rotatively affixed to the latch lever by means of a roll pin 39 passing through coaxial perforations in the cylindrical portion 11b and the end of the latch lever. At its other end, the body portion 11*a* of link 11 has a laterally extending cylindrical portion 11*c* adapted to accommodate the spring 13** of the bolt-link assembly, the purpose of which will be described hereinafter.

The bolt 12 has a latch pin portion 12a adapted to cooperate with the strike 15 (see FIG. 1). At its lower end, bolt 12 terminates in bifurcations **12*b* and 12*c*. The upper cylindrical portion 11*c* of link 11 is received between bolt bifurcations 12*b* and 12*c* and is pivotally affixed thereto by a pivot pin or rivet 40.**

Spring 13 has a first end **13*a* adapted to engage bifurcation 12*c* of the bolt and a second end 13*b* adapted to engage cylindrical portion 11*b* of the link. Spring 13 serves to normally maintain the bolt in a position overlying the link, as will be most evident from FIGS. 2 and 7.** The purpose of this normal orientation of the bolt with respect to the link will be described hereinafter.

Finally, bifurcation **12*c* of the bolt has a lateral extension 41** thereon. This extension is adapted to close the door safety switch when the bolt is in its latching position, as will be described hereinafter.

In FIGS. 2 and 7 the door safety switch 14 is shown mounted on bracket 33 of the support plate 8 by mounting screws 36 and 37. The switch 14 may be of any appropriate type having the required design characteristics to enable it to serve its desired purpose. As indicated above, in an appliance such as a dishwasher, door safety switch 14 will be so located in the appliance circuitry that the appliance will not function unless switch 14 is "closed". To further this purpose, switch 14 can only be closed if the latch mechanism of the present invention is in its closed and latching condition.

In the exemplary embodiment illustrated in FIGS. 2 and 7, switch 14 is shown as having a push-button actuator 42. A spring lever 43 overlies push-button 42. Spring lever 43 normally occupies the position shown in FIGS. 2 and 7. When the spring lever is engaged by lug 41 of bolt 12 and shifted toward switch 14 (as in FIGS. 3 and 4) it will cause push-button 42 to be depressed and switch 14 to be "closed".

Figure 5:
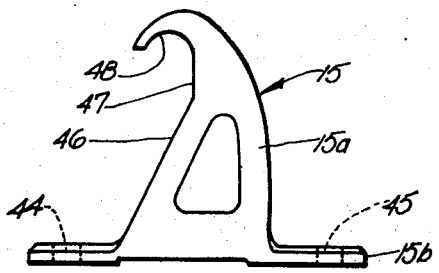
FIG. 5 is an elevational view of the latch strike.
Figure 6:
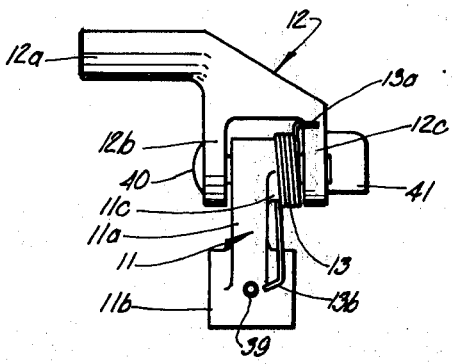
FIG. 6 is an elevational view of the bolt and link assembly of the present invention.

The strike 15 is clearly shown in FIG. 5. The strike 15 comprises a hook-shaped body portion **15*a* and a base portion 15*b*. The base portion is provided with holes 44 and 45 for fastening means (not shown) by which it may be affixed to the tub top flange 1, as shown in FIG. 1. The hook-shaped body portion 15*a* of the strike has a first cam surface 46, a second cam surface 47 and an arcuate engagement surface 48. These surfaces cooperate with the latch pin portion 12***a* of bolt 12 to cause it to achieve its latching position to be described hereinafter.

The individual parts of the latch mechanism having been described, the operation of the mechanism may be set forth as follows. FIGS. 1, 2 and 7 illustrate the latch mechanism in its normal, open condition. The open position of latch lever 9 is determined by its abutment with flange 21 of support plate 8. The latch lever is biased to this position by latch spring 10. Link 11 lies in parallel spaced relationship to the upper surface of support plate 8 and bolt 12 overlies link 11 by virtue of the action of bolt-link spring 13. Spring lever 43 of door safety switch 14 is in its normal position. As a consequence, push-button actuator 42 is in its normal, unactuated position and switch 14 will be in its "open" mode.

Figure 8:
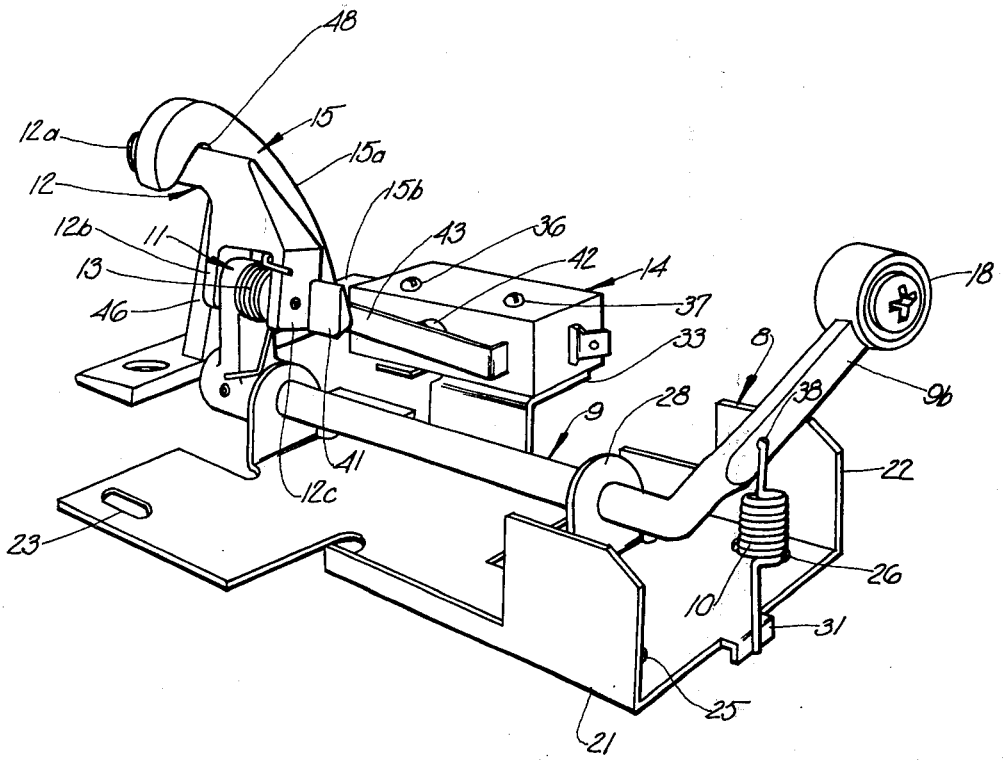
FIG. 8 is a perspective view of the latch mechanism of the present invention in its closed and latching position.

FIGS. 3 and 8 illustrate the latch mechanism in its closed and latching position. This position is achieved when the dishwasher door is brought by the operator to its closed or nearly closed position with the strike 15 entering the opening 17 in the door inner wall 4. To latch the door, it is only necessary for the operator to shift the latch lever 9 to its closed position wherein it lies in abutment with the flange 22 of support plate 8. In shifting from its open to its closed position, latch spring 10 causes the latch lever to pass through an over-center position with the result that, once past the over-center position, spring 10 will bias the latch lever to its closed position.

It will be evident from FIGS. 3 and 8 that a shifting of latch lever 9 from its open to its closed position will cause a shifting of link 11 in the same direction. This, in turn, will cause bolt 12 to first engage the cam surface 46 of strike 15. Further shifting of link 11 will cause bolt 12 to ride upwardly along strike cam surfaces 46 and 47 into engagement with the arcuate strike surface 48. This action serves a number of purposes. First of all, the interaction of the bolt 12 and strike 15 will cam the appliance door tightly shut so that the inner surface of the inner door wall 4 will be sealingly engaged by resilient seal 2 in the vat. There is a relatively large distance obtained between latch lever portion 9*a* and latch pin 12*a* providing a large mechanical advantage from the latch mechanism enabling the door to be pulled to its fully closed and sealed position with a minimum amount of effort on the part of the operator. Secondly, once the latch mechanism has achieved its closed and latching condition as illustrated in FIGS. 3 and 8, the pivot pin 40 joining the bolt 12 to the lever 8 will pass beyond an imaginary line drawn between the axis of portion 9*a* of the latch lever and the axis of latch pin 12*a* of the bolt. Thus the latch pin 12a assumes an overcenter position with respect to pivot pin 40 and the door will be securely latched in its shut position. Through the action of latch spring 10 and the over-center position of latch pin 12*a*, the latch mechanism will remain in its latching condition until purposefully shifted to its open condition by the operator. Finally, it will be noted that the upward shifting of bolt 12 will bring the lug 41 in position to contact the spring lever 43 of door safety switch 14. When the latch mechanism of the present invention has achieved its fully latching condition, lug 41 will have caused spring lever 43 and push-button actuator 42 to achieve those positions wherein the switch is in its "closed" mode enabling the appliance circuitry and the actuation of the dishwasher or the like through the various operations making up the cycle to be performed.

At the end of the appliance cycle, the operator may open the appliance door by simply shifting latch lever 9 from its closed position, through its over-center position to its open position as shown in FIGS. 2 and 7. All of the operative parts of the latch mechanism will assume their normal positions as shown in those figures. The bolt having been released from its engagement with the strike, the appliance door is free to be opened.

FIG. 9 illustrates the condition of the switch mechanism of the present invention should the latch lever be shifted to its closed position when the dishwasher door is open and the bolt cannot engage the strike. Since the latch pin portion 12*a* of the bolt does not engage strike cam surfaces 46 and 47 under these circumstances, the bolt will not be shifted upwardly. Instead, the bolt will remain in its normal position overlying link 11, by virtue of the bolt-link assembly spring 13. When the bolt remains in this position, lug 41 thereof will not achieve appropriate orientation to engage switch spring lever 43. Rather, as illustrated in FIG. 9, the lug 41 will simply pass beneath the switch spring lever 43 and switch 14 will remain in its "open" mode with the result that the appliance will not function.

In the exemplary embodiment described above the strike is mounted on the tub flange and the remainder of the latch mechanism is mounted in the door. It would be within the skill of the worker in the art to mount the strike on the appliance door and the remainder of the latch mechanism on the tub or the appliance cabinet in those instances where such an arrangement would be more convenient.

Figure 10:
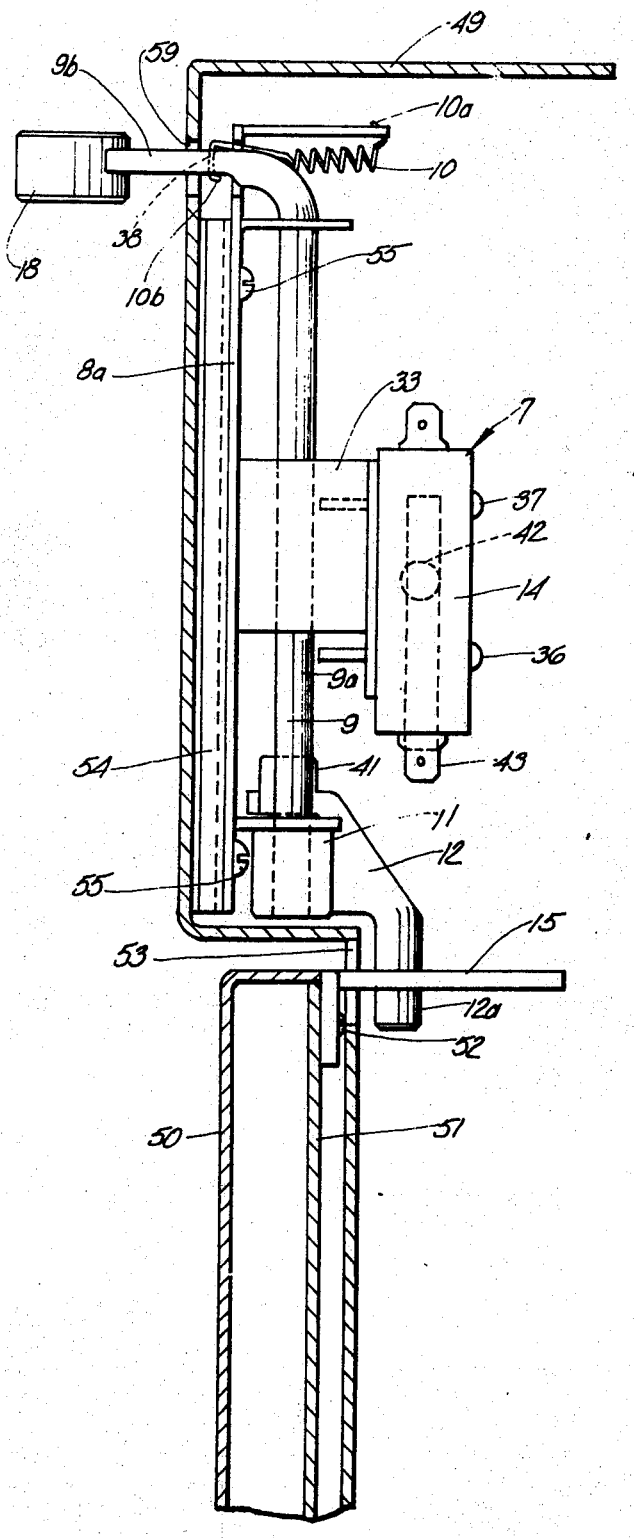
FIG. 10 is a fragmentary side elevational view, partly in cross section, illustrating a portion of the cabinet and door of an under-counter dishwasher and showing the application of the latch mechanism of the present invention wherein the strike is affixed to the door and the support plate is affixed to the cabinet.

FIG. 10 illustrates an exemplary embodiment wherein the strike is mounted on the dishwasher door and the remainder of the latch mechanism is mounted within the dishwasher cabinet. With a few minor modifications to be discussed hereinafter, the latch mechanism and strike of FIG. 10 are identical to those described with respect to FIGS. 1 through 9 and like parts have been given like index numerals. In FIG. 10 the appliance cabinet is shown at 49 and the appliance door is shown at 50, having an inner panel 51. Again, the tub will be provided with gasket means (not shown) with which the door will make sealing engagement when fully closed. The strike 15 is affixed to the inner panel 51 of the door by appropriate fastening means such as screws or the like, one of which is shown at 52. The strike 15 is so located on the door inner panel 51 as to pass through a perforation 53 in the cabinet, when the door is in its closed position.

A bracket means 54, similar to bracket means 6 of FIG. 1, is affixed to the inside surface of cabinet 49 in any appropriate way such as by welding or through the use of fastening means. Bracket means 54 supports the latch assembly of the present invention, again generally indicated at 7. The latch assembly 7 is affixed to bracket 54 by machine screws (some of which are shown at 55) or other appropriate fastening means.

As in the case of FIG. 1, the primary elements of the latch assembly of FIG. 10 comprise support plate 8a, latch lever 9, latch spring 10, link 11, bolt 12, a link and bolt assembly spring (not shown, but identical to that illustrated in FIG. 6), door safety switch 14 and strike 15.

Figure 11:
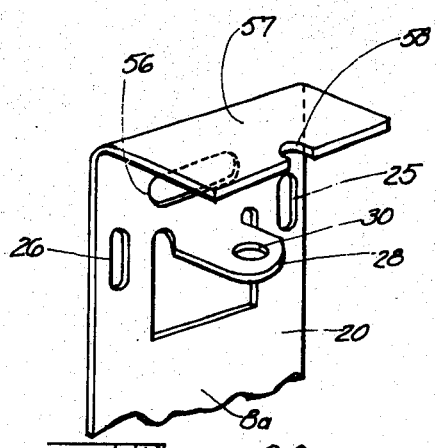
FIG. 11 is a fragmentary perspective view of a modified latch housing or support plate of the present invention.

Support plate 8*a* is identical to support plate 8 of FIG. 4 with the exception that a transverse slot 56 is provided adjacent tab 30 and the downwardly depending flange 31 bearing notch 32 has been replaced by an upwardly extending flange 57 bearing notch 58 (see FIG. 11).

The only other difference between the latch mechanism of FIG. 10 and that of FIGS. 1 through 9 lies in the fact that latch lever 9 (otherwise identical) is so oriented that its laterally extending portion 9*b* carrying latch handle 18 passes through the transverse slot 56 in support plate 8a and through a slot 59 in the dishwasher cabinet 49. Latch spring 10 serves the same purpose as described with respect to FIGS. 1 through 3 with its end 10*a* located in notch 58 in flange 57 and its end 10*b* passing through slot 56 in support plate 8*a* and engaged in perforation 38 in latch lever portion 9*b*. While support plate 8*a* may be provided with upturned sides as shown at 21 and 22 in FIG. 4, these sides may be eliminated as shown in FIGS. 10 and 11. The transverse slot 56 in the support plate 8*a* is so sized as to have its ends serve as stops for latch lever 9, determining its open and closed or latched positions, respectively.

In all other respects, the latch assembly of FIGS. 10 and 11 operates in an identical manner as described with respect to the embodiment of FIGS. 1 through 9, the individual elements thereof bearing the same relationships to each other and performing the same functions in the same manner for the same purposes.

Modifications may be made in the invention without departing from the spirit of it.

The embodiments of the invention in which an exclusive property or privilege is claimed are defined as follows:

1. An improved latch mechanism comprising a support plate having upstanding lugs in parallel spaced relationship with coaxial perforations therethrough, an L-shaped latch lever the first leg of which comprises a rod-like portion rotatively mounted in said perforations of said support plate lugs, the second leg of said L-shaped latch lever comprising a handle portion with handle means at the end thereof, said latch lever being rotatable in said support plate lug perforations by said handle portion between an open position and a closed position, a link non-rotatively affixed to the free end of said first latch lever leg, a bolt means, means pivotally affixing said bolt to said link, said bolt means being independently swingable between a normal position and a latching position with respect to said link, means to bias said bolt to said normal position, a hookshaped strike, said bolt having a strike engaging portion, said strike having at least one cam surface thereon for engagement by said strike engaging bolt portion and so configured as to shift said bolt from said normal position to said latching position as said latch handle is shifted from said open to said closed position.

2. The structure claimed in claim 1 wherein said strike engaging portion of said bolt lies in over-center relationship to said means pivotally affixing said bolt to said link when said bolt is in said latching position.

3. The structure claimed in claim 1 including a tension spring, one end of said tension spring being affixed to said support plate, the other end of said spring being affixed to said second leg of said latch lever, said spring having an over-center relationship with said latch lever so as to tend to retain said latch lever in either of said open and said closed positions.

4. The structure claimed in claim 1 including an electric switch, said switch having actuating means, a lug on said bolt so positioned thereon as to contact said switch actuating means and to operate said switch when said bolt is in said latching position.

5. The structure claimed in claim 4 wherein said switch is mounted on said support plate.

6. In an appliance of the type having a cabinet and an access door for the interior of said cabinet, an improved latch mechanism for opening, closing and latching said appliance door, said latch mechanism comprising a support plate affixed to one of said door and said cabinet and having upstanding lugs in parallel spaced relationship with coaxial perforations therethrough, an L-shaped latch lever the first leg of which comprises a rod-like portion rotatively mounted in said perforations of said support plate lugs, the second leg of said L-shaped latch lever comprising a handle portion with handle means at the end thereof, said latch lever being rotatable in said support plate lug perforations by said handle portion between an open position and a closed position, a link non-rotatively affixed to the free end of said first latch lever leg, a bolt means, means pivotally affixing said bolt to said link, said bolt means being independently swingable between a normal position and a latching position with respect to said link, means to bias said bolt to said normal position, a hook-shaped strike affixed to the other of said door and said cabinet, said bolt having a strike engaging portion, said strike having at least one cam surface thereon for engagement by said strike engaging bolt portion when said door is in a nearly closed position, said at least one cam surface being so configured as to shift said bolt from said normal position to said latching position and to pull said door to its fully closed position as said latch handle is shifted from said open to said closed position.

7. The structure claimed in claim 6 wherein said strike engaging portion of said bolt lies in over-center relationship to said means pivotally affixing said bolt to said link when said bolt is in said latching position.

8. The structure claimed in claim 6 including a tension spring, one end of said tension spring being affixed to said support plate, the other end of said spring being affixed to said second leg of said latch lever, said spring having an over-center relationship with said latch lever so as to tend to retain said latch lever in either of said open and said closed positions.

9. The structure claimed in claim 6 including an electric switch, said switch having actuating means, a lug on said bolt so positioned thereon as to contact said switch actuating means and to operate said switch when said bolt is in said latching position.

10. The structure claimed in claim 6 wherein said switch is mounted on said support plate.

11. An improved latch mechanism comprising a strike, a bolt, a latch actuator and an electric switch having a switch actuating means, said latch actuator being rotatable between an open position and a closed position, said bolt being operatively connected to said latch actuator, said bolt being shiftable between a normal position and a latching position, said bolt having a strike engaging portion, said strike being hookshaped and having at least one cam surface thereon, said strike cam surface being so configured as to shift said bolt from said normal to said latching position in latching engagement with said strike only when said cam surface is contacted by said strike engaging portion of said bolt and said latch actuator is shifted from said open to said closed position, means to bias said bolt to said normal position and to maintain said bolt in said normal position when said strike engaging portion of said bolt is out of contact with said strike and said latch actuator is in either of said open and closed positions, lug means on said bolt so positioned thereon as to contact said switch actuating means and to operate said electric switch only when said bolt is in said latching position in latching engagement with said strike.

* * * * *